US005268534A

United States Patent [19]

Gailey et al.

[11] Patent Number: 5,268,534

[45] Date of Patent: Dec. 7, 1993

[54] BRAIDED FLATTENED TUBE CONDUCTOR

[76] Inventors: Brian L. Gailey, 6819 Castille de Oro, San Antonio, Tex. 78239; Jefferson J. Honeycutt, P.O. Box 29931, San Antonio, Tex. 78229

[21] Appl. No.: 858,405

[22] Filed: Mar. 27, 1992

[51] Int. Cl.[5] ..... H01B 1/02

[52] U.S. Cl. ..... 174/126.2; 87/9; 174/94 R

[58] Field of Search ..... 174/126.2, 109, 94 R; 87/8, 9; 446/444, 445, 446

[56] References Cited

U.S. PATENT DOCUMENTS

| | | | |
|---|---|---|---|
| 2,268,617 | 1/1942 | Pierce | 174/126.2 |
| 3,643,007 | 2/1972 | Roberts et al. | 174/109 |
| 3,964,206 | 6/1976 | Bernhard | 446/455 |
| 4,031,661 | 6/1977 | Bernhard | 446/130 |
| 4,386,777 | 6/1983 | Prehodka | 446/444 X |
| 4,429,488 | 2/1984 | Wessels | 446/446 |
| 4,642,417 | 2/1987 | Ruthrof et al. | 174/109 X |
| 4,940,444 | 7/1990 | Russell | 446/444 X |

FOREIGN PATENT DOCUMENTS

| | | | |
|---|---|---|---|
| 2210278 | 6/1989 | United Kingdom | 446/444 |

*Primary Examiner*—Morris H. Nimmo

[57] ABSTRACT

A combination Malleable Carbon Steel/Copper Wire Braided material. This braided material will allow the use of chassis mounted magnets on 1/24th and 1/32nd scale model Slot Cars for use as magnetic traction and downforce devices. Said braid being made of a combination including a copper plating over each individual strand of malleable carbon steel wire will provide a sufficient mass of steel while also providing the least resistive and most flexible conductor.

2 Claims, 1 Drawing Sheet

BRAIDED FLATTENED TUBE CONDUCTOR

BACKGROUND OF THE INVENTION

1. Field of Invention

The present invention relates to a device that when securely attached to the surface of a slot car track will allow the use of magnets as a traction device in scale model slot cars. To be more specific, the present invention is constructed of a combination of materials which make it possible to use magnets on slot car chassis to provide more downforce, therefore allowing the slot car to get maximum traction while also getting maximum available D.C. current and amperage.

2. Prior Art

A lack of traction has long existed in the hobby of model slot car racing. In the past they have used petroleum distillate products which are also known in the industry as "GLUE" or sticky substances to aid in braking, cornering, and accelerating. Also used are aerodynamic and/or ground effect devices, (i.e. tail wings, side dams, and diaplanes) all in direct connection with the Lexan bodies. The above devices all work with limited success.

Magnetic traction is currently being used in H.O. scale slot car racing, however it is of a totally different form because of the design of both the cars and tracks. The H.O. format uses a track made of injection molded plastic with a slot located in the center of each lane and two steel rails set at a distance from the slot as to be just inside of the wheel tracks of an H.O. scale slot car. Said steel rails provide both D.C. current and a steel base for the use of magnets as traction devices.

Commercial 1/24th and 1/32nd scale slot car tracks are made of high density fiber boards and high grade particle boards. These boards are power routed with several slots which are made as a combination guide slot/power transmission point. The material currently being used to transmit D.C. current is a 100% copper wire braided material which is placed just below the surface at zero distance away from either side of the routed slot. This makes the format totally different than H.O. scale. Said copper braided material has no properties that make the use of magnets as traction devices possible.

No device is known that when installed on a commercial or private 1/24th or 1/32nd scale slot car track provides the properties necessary to allow the use of magnets as magnetic traction devices while still allowing the least amount of electrical resistance.

SUMMARY OF THE INVENTION

The principal object of the present invention is to provide a flexible and highly conductive material that is made with sufficient quantities of malleable carbon steel as to allow the use of chassis mounted magnets which will provide downforce as well as additional traction over and above what is available from weight and gravity.

It is also an object of the present invention to provide a material that is the least expensive way to bring magnetic assisted traction to 1/24th and 1/32nd scale slot car tracks.

Another object of the present invention is to provide a material that when installed and used to its full potential will provide a cleaner, safer, and faster 1/24th and 1/32nd scale slot car track.

Another object of the present invention is to eliminate the need for liquid petroleum distillate products (Also known in the industry as "GLUE") to be applied to the track surface to aid in braking, cornering, and accelerating.

The foregoing objects can be accomplished by providing a flexible wire product consisting of a malleable carbon steel wire that has been electroplated with copper then arranged in several number carrier groups which are then braided into a tubular fashion and flattened. When used in place of common copper wire braid the present material will provide the malleable carbon steel in sufficient amounts necessary to allow the use of chassis mounted magnets as magnetic traction devices. All this while still maintaining the high conductivity of copper which in itself is proven to be the most satisfactory conductor for 1/24th and 1/32nd scale slot cars.

DETAILED DESCRIPTION

Figure 1:
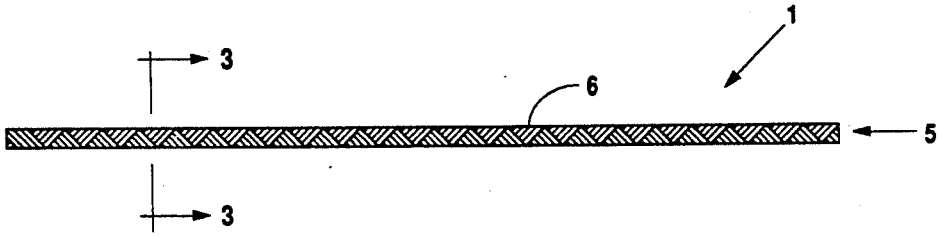
FIG. 1 is a side elevation of the Combination Steel/-Copper Braid.
Figure 2:
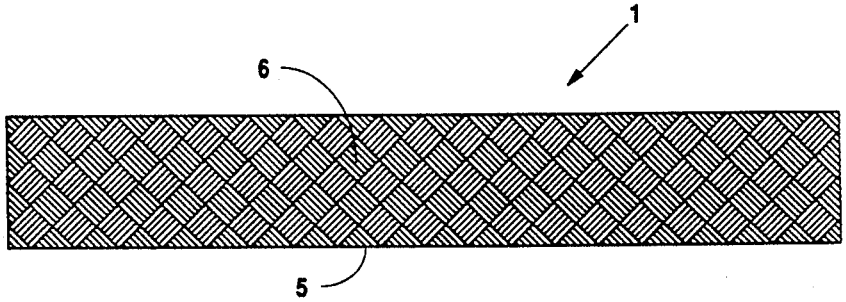
FIG. 2 is a top view of the Combination Steel/Copper Braid.
Figure 3:
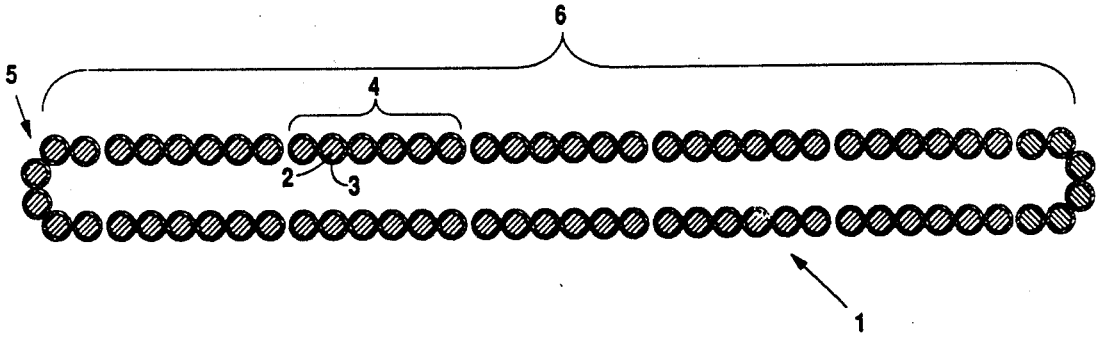
FIG. 3 is a cross section view showing individual stands, strand plating, carrier grouping, and carriers braided.

As shown in the drawings. (FIGS. 1–3). The combination Steel/Copper Braid 1 consist of single malleable carbon steel wire strand 2. Which have been electroplated with copper 3. Said strands are then arranged in a predetermined number as a carrier group 4. A predetermined number of carrier groups 4 are then braided into the form of a tube 1. The tubular braid is then flattened 5 to provide maximum contact surface area. 6

We claim:

1. An electrical conductor comprising a plurality of highly magnetically attractable malleable carbon steel wires that are braided into a flattened tube, with each wire being plated with copper, whereas the flattened tube forms a flexible and abrasion resistive magnetically attractable surface to surface direct current conductor.

2. An electrical conductor according to claim 1, wherein the braided flattened tube comprises a predetermined number of carrier groups of said wires and each carrier group being formed by a predetermined number of said wires.

* * * * *